United States Patent [19]

Wischusen, III

[11] Patent Number: 4,497,433

[45] Date of Patent: Feb. 5, 1985

[54] COMBINATION FOOD TRAY

[75] Inventor: Henry Wischusen, III, Lilburn, Ga.

[73] Assignee: Rock-Tenn Company, Norcross, Ga.

[21] Appl. No.: 534,186

[22] Filed: Sep. 20, 1983

Related U.S. Application Data

[63] Continuation-in-part of Ser. No. 414,952, Sep. 3, 1982, abandoned.

[51] Int. Cl.[3] ..... B65D 5/10

[52] U.S. Cl. ..... 229/30; 206/562; 206/620; 206/628; 206/634; 229/41 B

[58] Field of Search ..... 229/28 R, 30, 41 R, 229/41 B, 33; 206/562, 563, 564, 565, 491.1, 620, 634, 434, 628

[56] References Cited

U.S. PATENT DOCUMENTS

| | | | |
|---|---|---|---|
| 1,925,102 | 9/1933 | Levkoff . | |
| 2,112,433 | 3/1938 | Boeye . | |
| 2,238,545 | 4/1941 | Whiley . | |
| 2,266,958 | 12/1941 | Corbin . | |
| 2,403,840 | 7/1946 | Ashurst . | |
| 2,604,980 | 7/1952 | Reid . | |
| 2,663,489 | 12/1953 | Paige . | |
| 2,692,721 | 10/1954 | Pennebaker et al. . | |
| 2,711,819 | 6/1955 | Vander Lugt, Jr. . | |
| 2,732,983 | 1/1956 | Siddall . | |
| 2,875,940 | 3/1959 | Dunn | 229/30 |
| 3,005,584 | 10/1961 | Coe . | |
| 3,074,615 | 1/1963 | Johnson | 229/34 HW |
| 3,195,719 | 7/1965 | Giesler . | |
| 3,208,583 | 9/1965 | Kamps . | |
| 3,215,332 | 11/1965 | Bess . | |
| 3,281,054 | 10/1966 | Buttery et al. . | |
| 3,288,344 | 11/1966 | Woollen et al. . | |
| 3,322,329 | 5/1967 | Castaneda et al. | 206/629 |
| 3,323,706 | 6/1976 | Gereke . | |
| 3,326,445 | 6/1967 | Goings | 229/30 X |
| 3,348,672 | 10/1967 | Brown . | |
| 3,349,985 | 10/1967 | Salway . | |
| 3,365,114 | 1/1968 | Macchi | 229/38 |
| 3,376,974 | 4/1968 | Hilliard . | |
| 3,397,776 | 8/1968 | Weiss . | |
| 3,398,856 | 8/1968 | Graser . | |
| 3,411,696 | 11/1968 | Ayer et al. . | |
| 3,502,488 | 3/1970 | Bridgford . | |
| 3,512,697 | 5/1970 | Robinson . | |
| 3,522,907 | 8/1970 | Utterback, Jr. . | |
| 3,580,483 | 5/1971 | Young | 206/491.1 X |
| 3,587,837 | 6/1971 | Smith | 206/45.19 X |
| 3,604,560 | 9/1971 | Farquhar . | |
| 3,618,848 | 11/1971 | Palowski . | |
| 3,637,130 | 1/1972 | Farquhar . | |
| 3,659,707 | 5/1972 | Nilsson et al. . | |
| 3,669,251 | 6/1972 | Phillips, Jr. . | |
| 3,679,122 | 7/1972 | Neff . | |
| 3,705,681 | 12/1972 | Rossi et al. . | |
| 3,722,781 | 3/1973 | Page et al. . | |
| 3,829,006 | 8/1974 | Spiegel . | |
| 3,904,029 | 9/1975 | Koltz . | |
| 3,907,195 | 9/1975 | Struble . | |
| 3,938,731 | 2/1976 | Ross, Jr. et al. . | |
| 3,977,518 | 8/1976 | Arneson . | |
| 4,000,811 | 1/1977 | Hardison et al. . | |
| 4,069,917 | 1/1978 | Stollberg et al. | 229/39 R X |
| 4,112,100 | 9/1978 | Soja et al. . | |
| 4,130,237 | 12/1978 | Struble . | |
| 4,180,165 | 12/1979 | Kuchenbecker . | |
| 4,221,320 | 9/1980 | Faller . | |
| 4,326,356 | 4/1982 | Mason . | |
| 4,360,107 | 11/1982 | Roccaforte . | |

FOREIGN PATENT DOCUMENTS

| | | | |
|---|---|---|---|
| 272792 | 1/1967 | Australia | 229/39 B |
| 268988 | 2/1969 | Australia . | |
| 687951 | 6/1964 | Canada | 206/626 |
| 2805432 | of 1978 | Fed. Rep. of Germany | 206/628 |
| 1400046 | 4/1965 | France | 206/45.31 |

*Primary Examiner*—William Price
*Assistant Examiner*—Gary E. Elkins
*Attorney, Agent, or Firm*—Jones & Askew

[57] ABSTRACT

A carton of paperboard or the like includes side and end wall panels joined by an automatic bottom closure, cover panels extending from the side panels to enclose the carton, and connecting panels joining the cover and end wall panels such that locking tabs insertable into the end wall panels are formed when the cover panels are closed. Mating score configurations defined in the cover panels align to form an opening to receive an article, such as a drink container, which extends partially above the cover after insertion, and to form a tear-away section which is removable to expose the interior of the carton.

11 Claims, 6 Drawing Figures

COMBINATION FOOD TRAY

CROSS-REFERENCE TO RELATED APPLICATION

This application is a continuation-in-part of U.S. application Ser. No. 414,952, filed September 3, 1982, now abandoned.

TECHNICAL FIELD

The present invention relates to disposable containers formed from a single sheet of paperboard or the like, and particularly relates to a collapsible tray for holding both a drink container and a food container.

BACKGROUND ART

Many attempts have been made in the food and concessions industry to provide customers with convenient containers in which to carry food and drink from the point of sale to the place where the customer intends to consume the food. In many cases, the food is wrapped, the soft drink cups are capped with plastic snap-on closures, and both are placed in paper sacks. Since paper sacks have no rigidity, this practice leads to a possibility that the drink will leak or that food in open ended containers, such as french fries or popcorn, will fall to the bottom of the sack.

Some more rigid paperboard trays have been developed to provide a better means for transporting the food and drink. In one well known tray, four receptacles for retaining drink cups are provided, two at each end of the tray separated by an open area into which the food can be placed. While representing an improvement over the use of paper sacks, such trays leave exposed food such as popcorn or french fries unprotected. Also, such trays are generally shallow, and are unstable when carried by hand with several drinks in place.

SUMMARY OF THE INVENTION

The present invention solves problems with prior art combination drink and food trays by providing a collapsible tray for holding both a drink container and an additional food in a manner which provides stability to the drink container and substantially protects the food until eaten.

Generally described, the present invention provides, in a carton formed of paperboard or the like including a pair of longitudinally extending side panels held in spaced apart relation by a pair of transversely extending end panels foldably connected to the side and end panels, the improvement comprising a pair of cover panels each foldably connected to one of the side panels and extending transversely at least half the distance between the side panels, the cover panels including means for defining mating recesses in longitudinal free edges thereof such that the recess defining means align when the cover panels are folded inwardly to enable formation of an opening for receiving and supporting an item inserted downwardly into the opening, and means for securing the cover panels in a position folded inwardly to substantially enclose the carton.

In the preferred embodiment, the carton can further comprise mating tear-away sections defined by the cover panels in longitudinally spaced apart relation to the recess defining means, the tear-away sections aligning, when the cover panels are folded inwardly, to enable exposure of the interior of the carton beneath the tear-away sections by removing them simultaneously.

For this purpose, the tear-away sections can define mating finger openings which align when the cover panels are folded inwardly, such that the tear-away sections can be grapsed and torn away together. Preferably, each of the tear-away sections extends transversely from the longitudinal free edge of one of the cover panels to one of the side panels and longitudinally from a point spaced apart from the recess defining means to one of the end panels. The tear-away sections can be separated from the side panels by zipper scores comprising a plurality of linear cuts defining a path of tearing, the cuts being spaced apart longitudinally from one another, and a plurality of arcuate cuts, each intersecting one of the linear cuts and extending such that both ends of the arcuate cut intersect a line drawn normal to the near end of the next adjacent linear cut.

The means for securing the cover panels preferably comprises a pair of connecting panels extending between the cover panels at both ends of the carton, the connecting panels each being foldably connected to both of the cover panels and to one of the end panels and including diagonal scoring positioned to form a tapering locking tab when the cover panels are folded inwardly, the end panels including cuts therein for receiving tapered tips of the locking tabs. The tear-away sections in the cover panels are preferably shaped to leave paperboard joining the side panels to the connecting panels at one end of the carton when the tear-away sections are removed.

The recess defining means preferably comprises U-shaped scores opening toward the longitudinal free edges of the cover panels, and a plurality of break-away scores extending radially inwardly from the U-shaped scores. The U-shaped scores become aligned when the cover panels are folded inwardly, to form a circular means for frictionally receiving a drink container. The radial break-away scores define tabs therebetween with an outer tab of each of the cover panels overlapping the outer tab of the other cover panel sufficiently that such tabs lock together upon insertion of the drink container.

The present invention also provides a paperboard blank suitably cut and scored for constructing the carton just described. The blank is shaped for nesting with adjacent blanks in order to conserve paperboard, and can be folded and glued into a flat shipping configuration from which the carton can be erected without further application of glue.

Thus, it is an object of the present invention to provide an improved paperboard container or tray for carrying and protecting food and the like.

It is a further object of the invention to provide an improved paperboard tray for carrying both a drink container and a food item.

It is a further object of the invention to provide a collapsible tray capable of supporting a drink container, carrying and concealing a food item, and allowing such food item to be easily exposed for consumption.

It is a further object of the invention to provide a paperboard container into which food items may be easily loaded and then secured by closing and locking a cover for the container, and from which the food items can be easily removed through a tear-away opening.

Other objects, features, and advantages of the present invention will become apparent upon reading the following detailed description of an embodiment of the invention, when taken in conjunction with the drawing and the appended claims.

DETAILED DESCRIPTION

Figure 1:
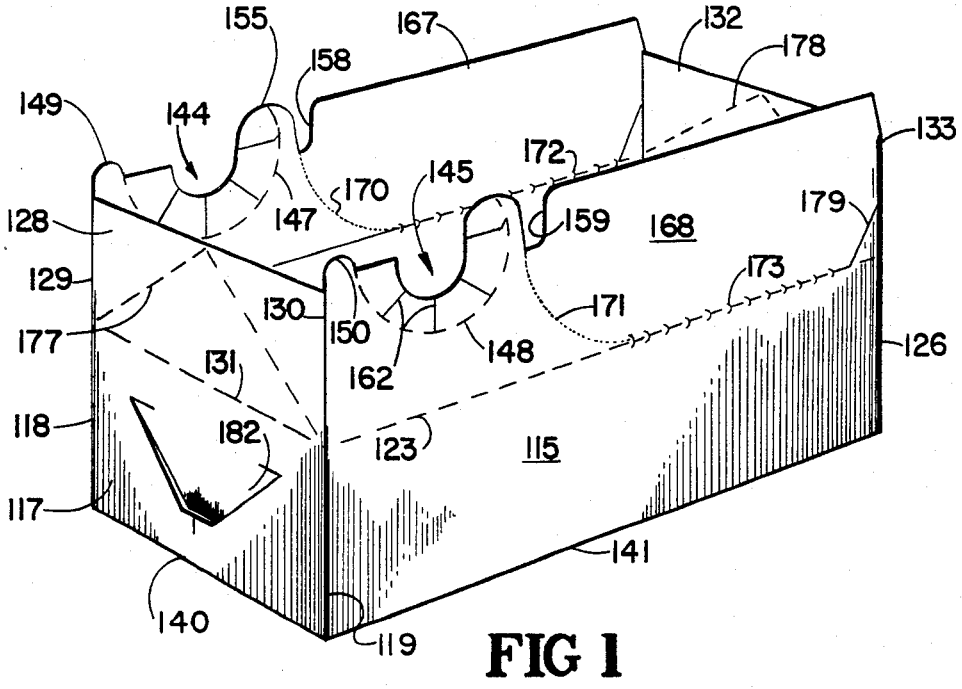
FIG. 1 is a pictorial view of a paperboard container embodying the invention, in erected form with the cover panels open.
Figure 2:
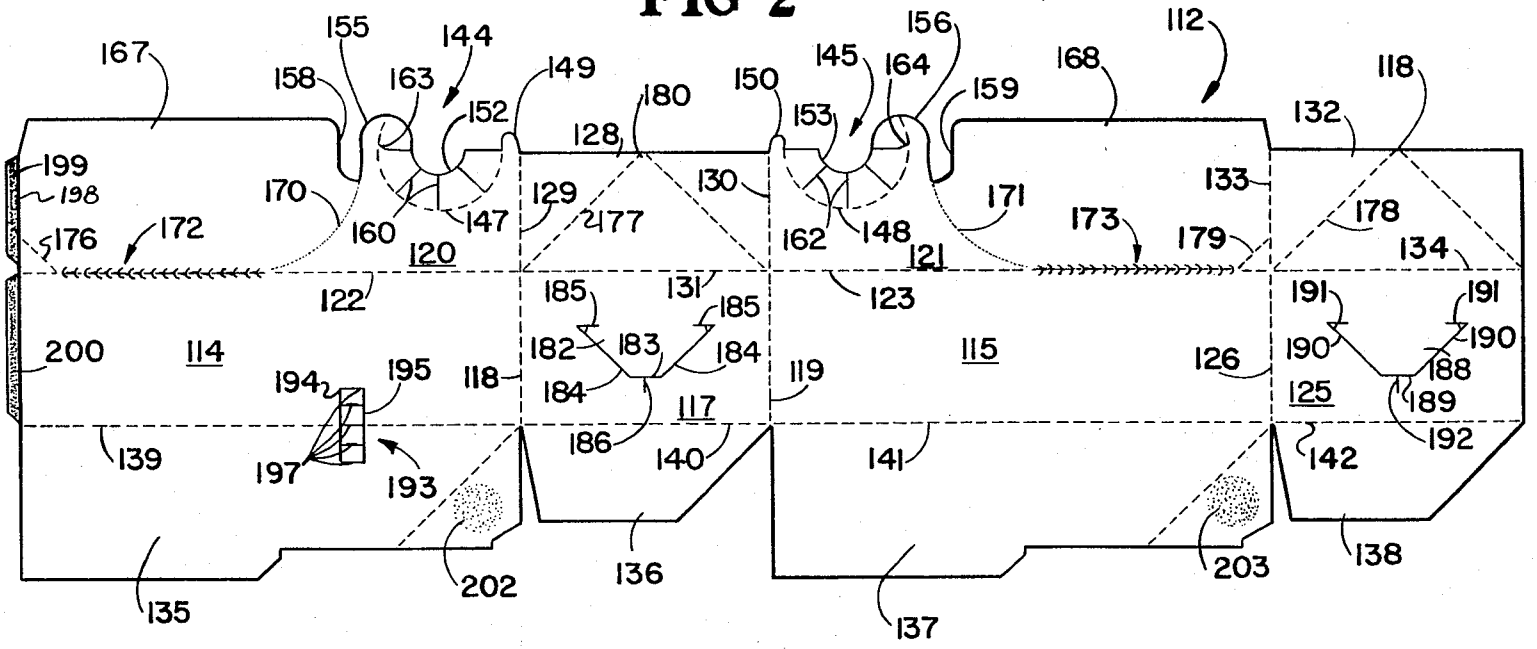
FIG. 2 is a plan view of a paperboard blank from which the container shown in FIG. 1 is assembled.

Referring now in more detail to the drawing, FIG. 1 shows a paperboard container or tray 110 embodying the present invention. FIG. 2 shows a paperboard blank from which the tray of FIG. 1 is formed. The tray 110 is an improvement over my invention shown and described in prior U.S. application Ser. No. 414,952, filed Sept. 3, 1982, which is expressly and fully incorporated herein by reference.

The tray 110 includes a first rectangular side panel 114 and a second rectangular side panel 115. A first end panel 117 connects the side panels 114 and 115 along transverse scores 118 and 119, respectively. A first cover panel 120 and a second cover panel 121 are connected to the side panels 114 and 115 along longitudinal scores 122 and 123, respectively. The cover panels 120 and 121 extend transversely for a width at least half the length of the end panel 117. The longitudinal scores 122 and 123 include novel zipper scores to be described in detail below. A second end panel 125 is attached to the second side panel 115 along transverse score 126, and extends longitudinally from the side panel 115. The end panel 125 is identical in size and shape to the end panel 117.

A first connecting panel 128 joins the cover panels 120 and 121, and the end panel 117. The connecting panel 128 is connected to the first cover panel 120 along a transverse score 129, to the second cover panel 121 along a transverse score 130, and to the end panel 117 along a longitudinal score 131. An identical second connecting panel 132 joins the second cover panel 121 and the second end panel 125. The connecting panel 132 is connected to the cover panel 121 along a transverse score 133 and to the end panel 125 along a longitudinal score 134.

The tray 110 includes a conventional automatic bottom closure including bottom panels 135–138, which are connected to side panel 114, end panel 117, side panel 115 and end panel 125 along longitudinal scores 139–142, respectively.

The free longitudinal edge of the first cover panel 120 defines therein a U-shaped recess 144 adjacent to the first connecting panel 128. A similar recess 145 is defined in the free longitudinal edge of the second cover panel 121. The recess 144 is defined by an arcuate score 147. Between one end of the arcuate score 147 and the connecting panel 128 a rounded tab 149 is formed. The tab 149 extends outwardly beyond the free edge of the connecting panel 128. Spaced farther from the panel 128 an arcuate edge 152 is defined spaced outwardly from and approximately concentric with the arcuate score 147, and continues to form a larger rounded tab 155. The tab 155 extends transversely outwardly between the recess 144 and a finger opening recess 158 which extends transversely inwardly from the edge of the cover panel 120 and is used in exposing the interior of the tray 110 in a manner described below.

The arcuate score 147 and the arcuate edge 152 are connected by a plurality of radial break-away scores 160. It will be seen that tabs are formed between the radial scores 160 when the paperboard material is separated at the scores 160, and that the outermost score 160 includes an angled leg 163 adjacent to the arcuate score 147. The tab formed outwardly of the leg 163 extends beyond the midpoint of the tray's width.

A similar configuration is formed in the second cover panel 121 as a mirror image when viewed in FIG. 2. Thus, the recess 145 is defined by an arcuate score 148 which is spaced inwardly from an arcuate edge 153, and connected thereto by a plurality of radial scores 162. The outer score 162 includes an angled leg 164. Rounded tab 150 corresponds to tab 149, and is located immediately adjacent to the other side of connecting panel 128. Rounded tab 156 corresponds to tab 155. A finger opening recess 159 is defined in the edge of the cover panel 121 on the side of the tab 156 farthest from the connecting panel 128.

Figure 3:
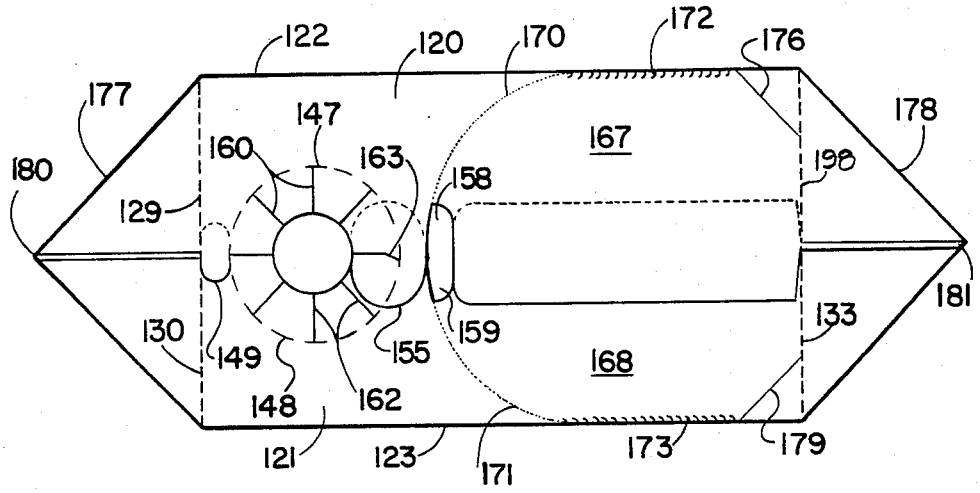
FIG. 3 is a top plan view of the erected container of FIG. 1, with the cover panels closed but not locked.

It should be understood that the edges 152 and 153 could be eliminated and the tabs formed between the break-away scores 160 and 162 could extend to be even with the edge of the connecting panel 128. If so, no actual opening will be formed by the edges 152 and 153 as shown in FIG. 3 when the carton is erected. Thus, the terms "recess" and "opening" in this context are intended to include the openable portion of the cover panels provided by the break-away scores 160 and 162. In either configuration the carton is substantially enclosed by the cover panels.

Figure 6:
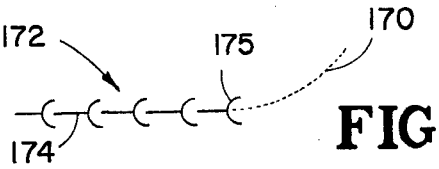
FIG. 6 is a diagrammatic view of the zipper score joining a tear-away panel to a side panel.

The cover panels 120 and 121 also define tear-away sections 167 and 168, respectively. The tear-away sections are spaced apart from the recesses 144 and 145 by the tabs 155 and 156. Referring first to the tear-away panel 167, a finely perforated tear score 170 extends arcuately from the finger opening 158 to the longitudinal score 122. From the point of intersection of the score 170 with score 122, extending away from connecting panel 128, score 122 is a zipper score 172 of the type shown in FIG. 6. The zipper score 172 includes a plurality of spaced apart linear cuts 174 which define a line of separation. For each linear cut 174, an arcuate cut 175 intersects one end of that linear cut, and both ends of the arcuate cut extend to intersect a line drawn normal to the near end of the next adjacent linear cut. The zipper score 172 provides a strong joint between the cover and side panels, but at the same time provides reliable tearing without delamination. When the tearing along the zipper score reaches the end of one of the linear cuts 174, any delamination or transverse tearing of the paperboard is trapped by the next adjacent arcuate cut 175 and thereby directed into the next linear cut which is along the desired line of separation.

As sown in FIGS. 2 and 3, the zipper score 172 ends at a point spaced from the edge of the cover panel 120. A perforated tear score 176 extends diagonally across a corner of the cover panel 120 to provide structural integrity and rigidity when the tear-away panel 167 is removed, as described below.

Tear-away section 168 is similarily defined by a finely perforated tear score 171 which curves from the finger opening 159 to intersect score 123, which extends as a zipper score 173 identical to zipper score 172 to a point spaced from transverse score 133 which separates cover panel 121 from connecting panel 132. A diagonal perforated tear score 179 corresponds to score 176. Score 133 is also a tear score in order to allow separation of the tear-away section 168 from connecting panel 132.

Referring to FIGS. 2 and 3, the connecting panels 128 and 132 each include a V-shaped score 177 and 178, respectively, the arms of the "V" intersecting the corners of the connecting panels adjacent to longitudinal scores 131 and 134, and the point of the "V" intersecting the midpoint of the free longitudinal edge of the connecting panels. When the cover panels 120 and 121 are folded inwardly as in FIG. 3, the connecting panels 128 and 132 fold outwardly to form pointed locking tabs having tips 180 and 181, respectively. The end panel 117 includes a push-in panel 182 defined by a cut 183 for receiving the tip 180, a pair of diagonal cuts 184 extending upwardly from the ends of the cut 183, and a pair of inwardly turned legs 185 parallel to the cut 183. A weakening slit 186 extends downwardly from the center of the cut 183 to allow the tip 180 to be more easily pressed past the cut 183. It will thus be seen that the push-in panel 182 moves inwardly to accommodate the bulk of the folded connecting panel 128.

The end panel 125 includes a push-in panel 188 defined by cut 189 with weakening slit 192, diagonal cuts 190 and inward legs 191. When the tray 110 is closed, the tip 181 is received behind the cut 189.

Figure 4:
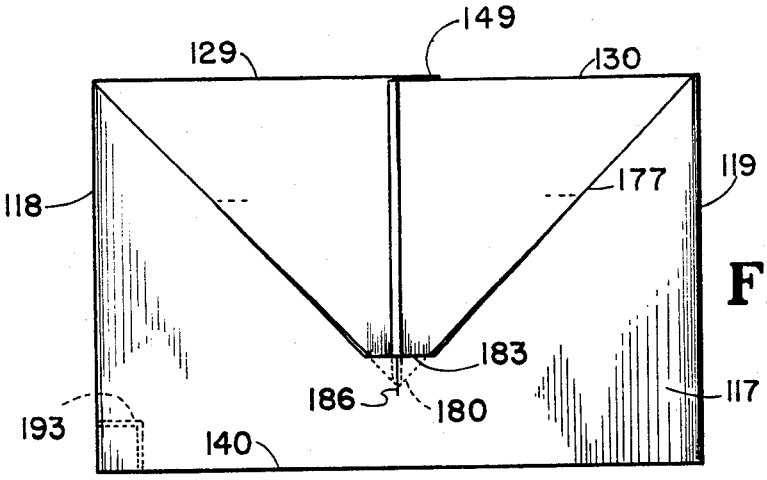
FIG. 4 is an end view of the container of FIGS. 1 and 3, with the cover panels closed and locked.

As shown in FIGS. 2 and 4, the tray 110 includes a stop panel 193 defined by portions of the side panel 114 and the automatic bottom panel 135. Parallel cuts 194 and 195 span the score 139 and are connected by a plurality of short longitudinal scores 197. After the tray 110 has been erected, the stop panel 193 can be popped into the interior of the tray 110, as shown in FIG. 4. In such a configuration it will prevent a large food item from sliding into a drink container positioned in the tray 110. If the food item is hotter or colder than the drink, the air space maintained by stop 193 helps to prevent heat transfer between the food and drink.

The blank 112 is completed by a transverse glue tab 199 extending from the transverse edge of the cover panel 120 and a similar transverse glue tab 200 extending from the transverse edge of the side panel 114. The tab 199 is separated from the cover panel 120 by a tear score 198 to enable separation of the tear-away section 167. Such glue tabs are used in the assembly of the tray 110, explained below.

In order to assemble the tray 110 in flat form for shipping, glue is applied to the glue tabs 199 and 200, and to the areas 202 and 203 shown on the automatic bottom panels 135 and 137. As FIG. 2 shows the surface of the blank 112 which becomes the exterior of the tray 110, the automatic bottom panels 135–138 are folded along scores 139–142 to lie against the back of the side panels 114 and 116 and the end panels 117 and 125. The glue panels 199 and 200 are also folded to lie against the backs of cover panel 120 and side panel 114. If machine folding and assembly is utilized, it may be necessary to apply glue as explained above after folding the panels 135–138, 199 and 200. Then the blank 112 is folded along scores 118/129 and 126/133 until the transverse edges of connecting panel 132 and end panel 125 adhere to glue tabs 199 and 200, and the bottom panels 136 and 138 adhere to the glue areas 202 and 203. The tray 110 is then fully assembled in flat form for convenience in shipping, ready to be erected without further application of glue.

Figure 5:
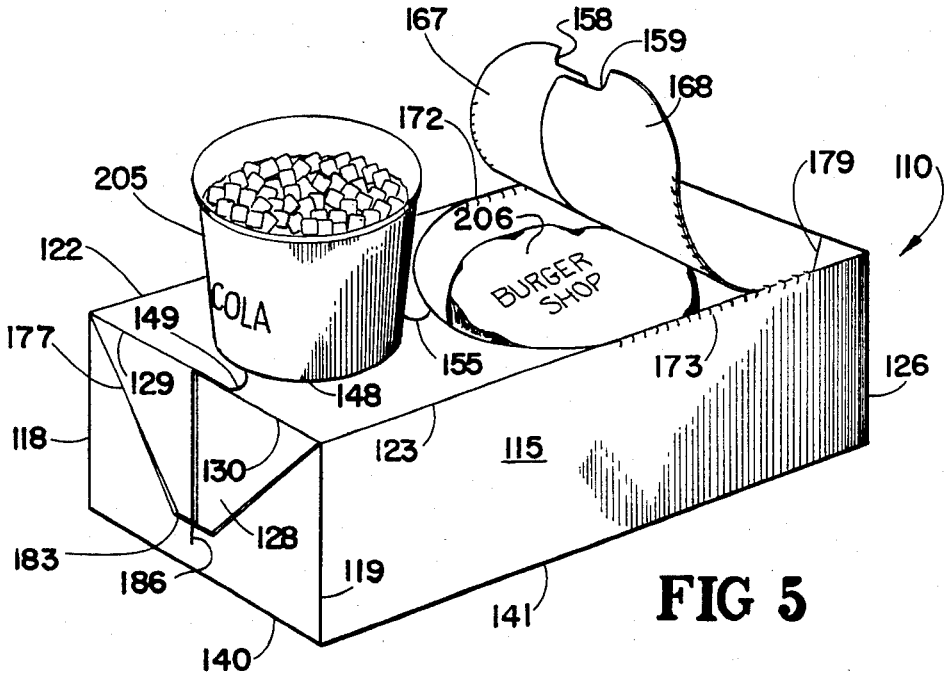
FIG. 5 is a pictorial view of the container of FIG. 1, showing a drink container inserted through the cover panels and the tear-away panels partially removed to expose a food item within the container.

To erect the tray 110 for use, the opposing side panel/end panel pairs 114/125 and 115/117 are forced apart in a conventional manner, causing the automatic bottom panels 135–138 to form and lock in a plane perpendicular to the side and end panels. The tray 110 then appears as shown in FIG. 1, ready for loading. A food item 206, such as a sandwich as shown in FIG. 5, is placed in the portion of the tray 110 away from the recesses 144 and 145 in the cover panels. Then the cover panels 120 and 121 are closed by pulling outwardly on the connecting panels 128 and 132. This causes the cover panels to fold inwardly along scores 122 and 123, and causes the connecting panels to fold along scores 177 and 178 to form locking tabs having pointed tips 180 and 181. After this step the tray 110 appears as shown in FIG. 3. It will be seen that the U-shaped recesses 144 and 145 have aligned to form a circular opening suitable for receiving a drink cup or can. It will also be seen that the tear-away panels align such that the finger openings 158 and 159 form a single finger opening and the arcuate scores 170 and 171 align along an arc reaching from the zipper score 172 to the zipper score 173.

The final step in closing the tray 110 is to fold the connecting panels down against the end panels until the tips 180 and 181 snap in behind the cuts 183 and 189, the push-in panels 182 and 188 giving in response to the inward pressure of the connecting panels. The tray 110 is now securely locked in its erected and locked position and has a high degree of structural rigidity which makes the tray easy to carry, even if only one hand is available for grasping the tray.

Either before or after loading the food item 206, the stop panel 193 can be popped into the tray 110 as shown in FIG. 4. This will be done normally when the food item is relatively large, such as a tub or tray for holding loose food such as popcorn or french fries. The stop 193 extends far enough into the tray 110 to engage the food container and to prevent it from sliding along the tray 110 to a position under the drink-receiving opening formed by the recesses 144 and 145. Of course, the size of the stop 193 and the extent to which it extends into the tray 110 can be altered as desired.

The tray 110 is now ready for insertion of a drink container 205, shown as a soft drink cup in FIG. 5. The circular opening formed by alignment of the edges 152 and 153 is smaller than the diameter of the cup 205, and therefore insertion of the cup depresses the tabs formed between the radial scores 160 and 162. These tabs exert stabilizing pressure on the cup, which is inserted until it rests upon the bottom of the tray 110. The arcuate scores 147 and 148 are preferably positioned to form a circle slightly larger than the diameter of the cup at the point along its height which ultimately is even with the cover panels 120 and 121. As the cup is inserted, the locking legs 163 and 164 of the outermost radial scores 160 and 162 tends to interlock with one another to assist in preventing the cover panels 120 and 121 from pulling apart.

In the form just described, the food and drink can be conveniently and safely transported. When it is desired to consume the food, the tear-away sections 167 and 168 are grasped between thumb and finger at the location of the finger opening 158/159. Since the tear-away panels each extend more than half way across the width of the tray 110 they overlie one another at the finger opening. By pulling upwardly the tear-away sections are simultaneously torn along perforated tear scores 170 and 171. Then upon further upward tearing, the sections 167 and 168 separate from the side panels 114 and 115 along zipper scores 172 and 173, as shown in FIG. 5. Finally, the sections are separated completely from the tray 110 by tearing along scores 176, 198, 133 and 179. The food within the tray 110 is thus fully exposed for easy removal or consumption.

It will be understood that the present invention can be embodied in containers having either a drink-receiving opening or a tear-away opening formed from two cover panel halves according to the invention. Alternate means could be used to secure the cover panels in a closed position or to define the bottom of the container. A blank of a different configuration from the elongate blank shown in FIG. 2 could be used to provide the bottom, sides and ends of the container. Different types of tear scores could be used to permit tearing or breaking away of the paperboard than those described.

While this invention has been described in detail with particular reference to a preferred embodiment thereof, it will be understood that variations and modifications can be made without departing from the spirit and scope of the invention as defined in the following claims.

What is claimed is:

1. In a carton formed of paperboard or the like including a pair of longitudinally extending side panels held in spaced apart relation by a pair of transversely extending end panels foldably connected to said side panels, and automatic bottom panel means foldably connected to said side and end panels, the improvement comprising:

a pair of cover panels each foldably connected to one of said side panels and extending transversely at least half the distance between the distance between said side panels, said cover panels including means for defining mating recesses in longitudinal free edges thereof such that said recess defining means align when said cover panels are folded inwardly to form an opening for receiving and supporting an item inserted downwardly into said opening; and means for securing said cover panels in a position folded inwardly to substantially enclose said carton;

said recess defining means comprising U-shaped scores opening toward the longitudinal free edges of said cover panels, and a plurality of break-away scores extending radially from said U-shaped scores to an acurate edge, said radial break-away scores defining tabs therebetween, such that an outer tab of each of said recess defining means overlaps the other recess defining means sufficiently to be beyond an outer tab of said other recess defining means, and said recess defining means further comprising lock score means for locking said outer tabs when said tabs are folded into said carton upon insertion of said item.

2. The carton of claim 1, further comprising mating tear-away sections defined by said cover panels in longitudinally spaced apart relation to said recess defining means, said tear away sections aligning, when said cover panels are folded inwardly, to enable exposure of the interior of said carton beneath said tear-away sections.

3. The carton of claim 2, wherein said tear-away sections define mating finger openings, said finger openings aligning when said cover panels are folded inwardly such that said tear-away sections can be grasped and torn away simultaneously.

4. The carton of claim 2, wherein each of said tear-away sections extends transversely from the longitudinal free edge of one of said cover panels to one of said side panels and longitudinally from a point spaced apart from said recess defining means to one of said end panels.

5. The carton of claim 4, wherein said tear-away sections are separated from said side panels by zipper scores comprising a plurality of linear cuts defining a path of tearing, said cuts being spaced apart longitudinally from one another; and a plurality of arcuate cuts, each intersecting one of said linear cuts and extending such that both ends of said arcuate cut intersect a line drawn normal to the near end of the next adjacent linear cut.

6. The carton of claim 1, wherein said means for securing said cover panels comprises a pair of connecting panels extending between said cover panels at both ends of said carton, said connecting panels each being foldably connected to said cover panels and to one of said end panels and including diagonal scoring positioned to form a tapering locking tab when said cover panels are folded inwardly, said end panels including cuts therein for receiving ends of said locking tabs.

7. The carton of claim 1, further comprising mating tear-away sections defined by said cover panels in longitudinally spaced apart relation to said recess defining means; and a pair of connecting panels each foldably connected to transverse edges of said cover panels and to one of said end panels; said tear-away sections leaving paperboard or the like joining said side panels to said connecting panels at one end of said carton when said tear-away sections are removed.

8. The carton of claim 1, further comprising stop means for preventing large items within said carton from sliding into the portion of said carton beneath said recess defining means.

9. The carton of claim 8, wherein said stop means comprises an L-shaped panel defined by two parallel cuts spanning the foldable connection between one of said side panels and said automatic bottom panel means, such that said L-shaped panel can be pushed into the interior of said carton.

10. A blank of paperboard or the like for forming a carton, comprising:

a first side panel and a second side panel;

a first end panel connecting said side panels and a second end panel extending from said second side panel;

first and second cover panels extending from an upper edge of said first and second side panels, respectively;

a first connecting panel extending between said first and second cover panels and said first end panel, and a second connecting panel extending between said second cover panel and said second end panel;

automatic bottom panel means extending from bottom edges of said side and end panels; and glue flaps extending from said first side panel and said first cover panel for attachment to said second end panel and said second connecting panel, respectively;

said cover panels including mating U-shaped recesses, said recesses aligning to form a circular opening when said blank is erected and including mating tear-away sections spaced apart from said U-shaped recesses; and said connecting panels including diagonal score means for collapsing said connecting panels into tapering locking tabs when said blank is erected and said cover panels are folded over the space between said side panels, said end panels including cuts for receiving extending ends of said locking tabs.

11. In a carton formed of paperboard or the like including a pair of longitudinally extending side panels held in spaced apart relation by a pair of transversely extending end panels foldably connected to said side panels, and automatic bottom panel means foldably connected to said side and end panels, the improvement comprising:

a pair of cover panels each foldably connected to one of said side panels and extending transversely at least half the distance between said side panels, said cover panels including means for defining mating U-shaped recesses in longitudinal free edges thereof and means for defining mating tear-away sections spaced apart from said U-shaped recesses, such that said recess defining means align when said cover panels are folded inwardly to form an opening for receiving and supporting an item inserted downwardly into said opening, and such that said tear-away section defining means align when said cover panels are folded inwardly to form a tear-away panel; and means for securing said cover panels in a position folded inwardly to substantially enclose said carton, comprising a pair of connecting panels extending between said cover panels at both ends of said carton, said connecting panels each being foldably connected to said cover panels and to one of said end panels and including diagonal scoring positioned to form a tapering locking tab when said cover panels are folded inwardly, said end panels including cuts therein for receiving ends of said locking tabs.

* * * * *